US005460479A

United States Patent [19]

Neumann et al.

[11] Patent Number: 5,460,479

[45] Date of Patent: Oct. 24, 1995

[54] SIGNATURE STACKING MACHINE

[76] Inventors: Irving H. Neumann, 1201 Milstone River Rd., Somerville, N.J. 08876; Kolbjorn Roste, Ovre Smedstadv 28B, 0378 Oslo 3, Norway

[21] Appl. No.: 197,227

[22] Filed: Feb. 16, 1994

Related U.S. Application Data

[63] Continuation of Ser. No. 688,039, Apr. 19, 1991, abandoned.

[30] Foreign Application Priority Data

Apr. 19, 1990 [NO] Norway ..... 901737

[51] Int. Cl.[6] ..... B65G 57/04

[52] U.S. Cl. ..... 414/789.5; 414/790.8; 414/790.2; 414/793; 271/218

[58] Field of Search ..... 414/789.5, 788.9, 414/790.8, 790.2, 793, 794.4; 271/218, 221

[56] References Cited

U.S. PATENT DOCUMENTS

| | | | |
|---|---|---|---|
| 2,933,314 | 4/1960 | Stobb . | |
| 3,378,258 | 4/1968 | Leuhrs . | |
| 3,724,840 | 4/1973 | Kuckermann . | |
| 3,949,112 | 9/1976 | Munn et al. | 414/789.5 |
| 3,969,993 | 7/1976 | Stobb . | |
| 3,972,524 | 8/1976 | Despot et al. | 271/218 |
| 4,245,832 | 1/1981 | Klenk et al. . | |
| 4,311,090 | 1/1982 | Dudziak et al. . | |
| 4,372,201 | 2/1983 | Dudziak et al. . | |
| 4,397,229 | 9/1983 | Merwarth et al. . | |
| 4,398,455 | 8/1983 | Merwarth . | |
| 4,400,124 | 8/1983 | Greller | 414/790.2 |
| 4,498,381 | 2/1985 | Convey, Jr. | 414/790.2 |
| 4,541,763 | 9/1985 | Chandjoke et al. . | |
| 4,554,867 | 11/1985 | Thumm . | |
| 4,570,535 | 2/1986 | Higgins et al. . | |
| 4,678,387 | 7/1987 | Sjorgen et al. . | |
| 4,723,883 | 2/1988 | Smith . | |
| 4,772,003 | 9/1988 | Nobuta et al . | |
| 4,772,169 | 9/1988 | Masini | 414/41 |
| 4,804,173 | 2/1989 | Pol et al. | 414/752 |
| 4,878,659 | 11/1989 | Besemann | 414/790.8 |
| 4,897,017 | 1/1990 | Castiglioni . | |
| 4,949,953 | 8/1990 | Claassen et al. | 414/790.8 |
| 4,978,275 | 12/1990 | Reid et al. | 414/789.5 |
| 5,060,929 | 10/1991 | Kohlmann | 271/218 |
| 5,110,112 | 5/1992 | Henn et al. | 271/218 |
| 5,215,428 | 6/1993 | Masini | 414/789.5 |

FOREIGN PATENT DOCUMENTS

| | | | |
|---|---|---|---|
| 387205 | 12/1988 | Austria . | |
| 1017101 | 12/1959 | Germany . | |
| 2022045 | 11/1971 | Germany . | |
| 2640032 | 11/1982 | Germany . | |
| 3712939 | 11/1988 | Germany | 414/790.2 |
| 419209 | 7/1981 | Sweden . | |
| 459086 | 6/1989 | Sweden . | |
| 1102788 | 7/1968 | United Kingdom . | |
| 1268895 | 3/1972 | United Kingdom . | |
| 1367832 | 9/1974 | United Kingdom . | |
| 1445447 | 8/1976 | United Kingdom . | |
| 1445913 | 8/1976 | United Kingdom . | |

*Primary Examiner*—Michael S. Huppert
*Assistant Examiner*—Gregory A. Morse
*Attorney, Agent, or Firm*—Mathews, Woodbridge & Collins

[57] ABSTRACT

A vertical signature stacking machine includes a frame, a vertical support wall, and a sliding support which intersects the vertical support wall. The sliding support translates along the support wall. Signatures are fed to a support plane on the sliding support to form a stack of signatures. There is a base support disposed to receive a stack of signatures from the sliding support. End boards are placed on the top and base of the stack by a rotatable end board gripper with a vacuum which can pick up end boards from an end board hopper and can release the end boards. A carriage is provided for bracing the completed stack. The carriage is disposed to travel along a path juxtaposed to the base travel path. The carriage has rotatably mounted arms having a bracing surface for moving the stack. The arms are positioned transverse to the support wall causing the bracing surface to intercept the stack and propel the stack along the base travel path.

16 Claims, 9 Drawing Sheets

SIGNATURE STACKING MACHINE

This is a continuation of Ser. No. 07/688,039, filed Apr. 19, 1991, now abandoned.

BACKGROUND OF THE INVENTION

1. Field of the Invention

The present invention relates to an apparatus for stacking signatures; more particularly, the present invention relates to a vertical signature stacking system.

2. Description of Related Art

There is disclosed in the art a wide variety of horizontal and vertical stacking machines. These machines are designed to stack sheets of paper, including "signatures". Typically, the signatures have a major plane and a perimeter and are stacked with the major planes of adjacent signatures in contact with the signature perimeters aligned. The signatures are usually rectangular shaped as they are fed from a printer or folding machine. Signatures are fed at a high rate of speed to the stacker, by a conveyor belt assembly.

Horizontal stackers stack the signatures with each individual signature in a vertical position supported on an edge. The stack has a stack axis which is horizontal. Vertical stackers have a vertical stacking support which supports the major plane of the signatures. The term "vertical" is nominal, and used to indicate that the stack is formed with the stack axis vertical or at an angle to the horizontal, typically greater than 45° and most commonly at 45° to 75°.

Useful horizontal stackers are disclosed in U.S. Pat. Nos. 4,723,883; 4,670,535; 4,245,832 and 3,378,258. Vertical stackers are also widely known and disclosed in U.S. Pat. Nos. 4,311,090; 4,372,201; 4,678,387; and 4,541,763. Stackers of interest are also disclosed in U.S. Pat. Nos. 4,398,455; 4,397,229; and 4,772,002.

Vertical stackers comprise a vertical stacking table having a vertical support wall. The vertical signature support wall extends from a feed end to a discharge end. The vertical signature support is nominally vertical, but typically at an angle of from 1° to 45° to the vertical. In this way the forming stack rests against the vertical support wall. The vertical stacking table has a sliding signature support fork which can translate up and down along the vertical support wall. The signature support fork can be transverse to and extend from the vertical support track. A stack is squared between the sliding signature support fork and the vertical signature support wall. There can be a feed fork assembly which supports the oncoming signatures as the stack begins to form. The forming stack is transferred from the feed fork to the primary fork. The formed stack on the primary support fork is removed to a bundling and strapping apparatus where the stack is compressed and strapped to form a bundle.

In forming the bundles it is desirable to have end boards or end plates at either longitudinal end of the stack. Apparatus to automatically insert end boards during the stacking operation are disclosed in U.S. Pat. Nos. 4,372,201; 4,311,090; and 4,554,867. Yet another approach is presented in U.S. Pat. No. 4,772,003. The state of the art has been such that the end boards are carefully fit at the ends of the stack. This is because of the rapidly moving and growing stack of signatures.

SUMMARY OF THE INVENTION

The present invention is directed to a vertical stacking system comprising in combination or separately various improvements, including an apparatus and method for producing gaps or causing interruption of a moving stream of sheets for signatures. There is a means to control the speed of the sliding signature supports, i.e., forks, as they descend within the vertical stacker. There is additionally a means to insert end boards or end plates which can be used automatically. There is a further means to assure that the side stacks are maintained without any portion of the stack axially offset during transition from the feed zone sliding support (fork) to the primary sliding support (fork). Additionally, there is a means to transport the formed stack to a compression and strapping zone. These improvements are preferably used with the vertical stacking apparatus of the present invention.

The following terms are used throughout the application. The apparatus is directed to stacking planar sheet-like material commonly known as "signatures". The signatures include single sheets or folded sheets typically made of paper or light cardboard. The apparatus is particularly useful in line with graphic arts machinery, such as printing presses and folding equipment.

A stack is an aligned plurality of signatures. Each signature has a major plane adjacent to the major plane of the adjacent signature. The perimeters of adjacent signatures are aligned. The stack has a stack axis which is generally perpendicular to the major plane of each signature and extends along the length of the stack.

A bundle is a stack that is compressed and secured, typically by plastic strapping.

By a vertical stacker it is meant an apparatus that forms a stack with the stack axis being at an angle to the horizontal. Typically, the angle is between 45° and 90° to the horizontal and most typically, between 45° and 75° with a typical and preferred angle of the stack being at 60° to the horizontal. As will be seen, this provides support for the stack along the stack end and one of the sides parallel to the stack axis.

The vertical stacking system of the present invention comprises a variety of features which can be used in combination, and some of which can be used independently with other stackers, including horizontal or vertical stackers. The features are used in combination in accordance with the preferred vertical stacking system of the present invention.

The vertical stacker of the present invention comprises a frame, and a vertical support wall supported by the frame. As indicated above, the vertical support wall is preferably at an angle of from 45° to 75° to the horizontal. The vertical stacking wall is preferably formed by a plurality of rollers. The rollers define a plane and angle of the wall. There is a sliding support defining a support plane which intersects the vertical support wall. Such a support plane is preferably a fork having prongs protruding through spaces between the rollers forming the vertical support wall. The upper surface of the prongs define a primary support plane.

There is a slide drive means to vertically translate the sliding support in the direction along the vertical support wall. Typically, this is a chain drive attached to a fork support means behind the vertical support wall. The chain causes the support plane to move vertically along the support wall. Preferably, the support plane is perpendicular to the plane defined by the support wall. The reason for this is that the stack nominally has a flat side which can rest against a support wall, and a stack perpendicular to the stack axis.

There is a means to feed signatures to the support plane of the primary sliding support to form a stack of signatures thereon. Signatures can be fed to the stacking machines at speeds up to and more than 80,000 signatures per hour. The stacking system of the present invention can handle a flow of signatures up to 80,000 signatures or more and typically, from 10,000 to 50,000 signatures per hour. There is a suitable means to feed the signatures to the primary support plane of the primary sliding support and form a stack of signatures thereon. A preferred feed means comprises a conveyor belt system on which a stream of overlapping signatures is continually fed to the vertical stacker system of the present invention.

The vertical stacking system has a feed zone along the vertical support wall. There can be a feed zone sliding support having a feed zone support plane which intercepts the vertical support wall. Preferably, the feed zone sliding support is a fork having a plurality of prongs extending through the spaces between the rollers defining the vertical support wall. The upper surface of the prongs define a feed zone support plane. The signatures being fed to the vertical stacker initially are fed directly onto the feed zone support plane and a stack begins to form with each successive signature being deposited on the preceding signature. As the stack forms, the feed zone sliding support moves vertically downward away from the conveyor belt. There is a feed zone drive means which is preferably a driven chain interconnected to a prong support means of the fork. The feed zone drive means translates the feed zone support plane in a controlled manner along the support wall vertically downward at the rate at which the stack is forming.

In a preferred embodiment of the present invention, the rate at which the feed zone support plane moves vertically downward can be controlled by a tension sensing means. The tension sensing means can sense the tensions in a belt adjacent to the top of the forming stack. The oncoming signatures are deposited on the stack between the top signature on the stack and the sensing means. Based on the tension in the belt, or pressure measured by the tension sensing means, the rate at which the vertical plane descends can be controlled. The tension sensing means can be located at any location along the belt and need not be directly on the forming stack. This feature enables the growing stack to move at a variable rate depending on the rate of the oncoming signatures. Additionally, it prevents hang-ups at the feed point. Finally, it can compensate for inconsistencies in the concentration of signatures along the signature feed stream. The means to sense and control the rate can also be a roller on the top of the stack being formed. The height of the roller can be sensed and used to control the rate of descent of the stack.

During operation of the vertical stacking system of the present invention, it is desirable to cause a gap in the oncoming signature stream or interrupt the flow of the stream. The purpose for this is to permit the feed means, preferably the feed zone sliding support to transfer into the feed zone prior to the forming of the next stack. In accordance with the present invention, a particular and useful feed means can be located immediately before the feed zone or at a remote location.

The preferred interrupt means comprises opposing conveyor belts. During normal operation the opposing conveyor belts can contact the upper and lower surface of the signature stream moving at the same speed so as to permit the signature stream to proceed unencumbered. If it is desirable to interrupt the flow of the stream or form a gap, either of the upper or lower conveyor belts can be operated at a faster or slower speed than the opposing conveyor belt. Preferably, the upper conveyor belt is slowed down, causing signatures in contact therewith to move slower than the signatures which are between the conveyor belt and the feed zone. This enables a gap to form. Alternately, the upper belt can be speeded up and the signatures between the opposing belts can move faster than the signatures behind them. Either way there is an interruption in flow in front of or behind the interrupt apparatus.

The apparatus can further comprise a signature interrupt means such as a hook or lance to actually contact a signature in the stream where the gap will be formed. The lance can move along with the interrupt belt at the same speed as the belt for a sufficient distance holding back and separating the signature on which it is acting to form the gap.

In accordance with the present invention, the signature stack on the feed support plane begins to grow. The feed support plane translates vertically down away from the feed zone toward the primary support plane. The primary support plane preferably has an end board thereon and comes up to meet the feed support. When the end board is immediately beneath the bottom of the feed support fork, the feed support fork can be retracted and the base of the stack is deposited on the end board. The signatures are then continually fed onto the forming stack which is now on the primary support plane, with the end board between the primary support plane and the base of the stack.

Under normal circumstances, this transition works smoothly and a uniform stack having uniform transverse sides is formed. However, occasionally a stack is formed of signatures having a fold along only one transverse side. As a result the tension on the stack between the feed means and the feed support plane of the fork is greater on the transverse side of stack having the fold. Upon retraction of the feed support fork, the difference in forces along the transverse direction of the stack causes a slight rotation and a notch along the transverse side of the stack. A guide can be placed at the location where the feed fork retracts and the base of the stack is deposited on the end board supported on the primary support plane. While a permanent guide can be used, a tight permanent guide associated with a moving stack could result in jam ups. This can be minimized by a guide which can move downward with the stack to avoid jam ups, such as a small conveyor or roll. More preferably, the guide is a retractable guide. There can be a control means to cause the guides to abut the transverse side of the stack immediately prior to the intercept of the feed zone fork with the end plates supported on the primary plane. In this way the guide surfaces come in and abut the transverse sides of the stack. Upon retraction of the feed zone fork, the transverse sides of the stack are guided to remain aligned and the notch does not form. The guide is then retracted.

A gap in the signature stream is coordinated to the completion of the formation of the stack on the primary support means. Upon formation of the completed stack, the primary support means moves down the vertical wall. At the bottom of the vertical wall is a base having a base support plane disposed to receive the stack of signatures from the primary sliding support. Preferably, the base is composed of a plurality of rollers perpendicular to the vertical support wall. The prongs of the primary support fork move through the gaps between the rollers with the end of the stack on an end board being supported on the rollers. The rollers can be used as part of a base travel path along which the signature stack can be transported.

The signature stack can be transported along the base rollers by having the rollers themselves being driven rollers. Preferably, the driven rollers can be controlled to operate at a desired rotation to control the speed at which the stack moves transverse to the vertical wall out of the stacking zone to the next area for processing. Typically, this is a zone which compresses the stack and secures it by a suitable strapping means to form a strapped compressed stack or bundle of signatures. In accordance with the present invention, the rollers can have a slip clutch or free gear type movement. Once the speed of the stack exceeds the desired rate, the rollers will rotate freely and no longer drive the stack.

In an alternate and preferred embodiment, there is a transport device to transfer the stack away from the stacking apparatus to the bundling apparatus. A preferred transporting device comprises a carriage which can travel along a track juxtaposed to the base travel path. There is a suitable means to propel the stack intact. That is, there is a means to prevent the signatures in the stack from being displaced along the stack axis.

In a preferred embodiment, the transport device comprises at least one arm extending from the carriage, the arm having a bracing surface. Preferably, there are two arms extending from the carriage, each arm having a bracing surface. There is a means to position the arms transverse to the support wall. In the transverse position the bracing surfaces on the two arms oppose each other. Movement of the arm into a transverse position causes the bracing surface of at least one of the arms to intercept the transverse side of the stack. The arm can propel the stack along the base travel path. In a preferred embodiment there is means to position the second arm transverse to the support wall with the second arm having a bracing surface opposing the first arm bracing surface whereby movement of the arm in the transverse position will cause the stack to be braced between the first and second arm bracing surfaces. The stack can be propelled intact by movement of the carriage along the base travel path. In this way, the stack will be fully supported along both transverse sides by the bracing surfaces of the carriage and on the side adjacent to the vertical support wall by the vertical support wall rollers. The stack can be transported supported along three of its transverse sides.

In a more preferred embodiment, the arms are rotatably mounted on the carriage and the bracing surfaces extend from the base support base parallel to the vertical support when the carriage is not in use. The arms can be rotated away from the support wall during the stacking and then rotated to brace the completed stack.

End boards are preferably placed at the base of the stack and at the top of the stack before the stack is formed into a bundle. The prior art teaches a variety of methods to correctly obtain and place end boards in an automatic manner. Such methods include hoppers in which end boards must be precisely stacked and transference of the end board from the end board hopper through very specific guides onto a support surface and onto the top of the stack. The reason for this is the concerns attendant with the rapid movement of the signature stream and the rapidly successive formation of stacks of signatures.

A feature of the present invention is a means to insert end board onto the primary support plane (on the primary fork) and onto the top of the stack without the necessity of the precision operation attendant with prior art apparatus. In essence, the present invention is forgiving of an inconsistent stack of end boards and can be used to precisely place the end board on the support surface (of a fork) and on top of the stack.

In accordance with the vertical stacking system of the present invention there is a means to place an end board. This means comprises an end board hopper and an end board arm having an end board gripper at the end. There is a means to move the end board gripper from the hopper to a position above the support plane. There is further a means to release the end board associated with the end board gripper. During operation the arm moves to the end board hopper, grips an end board, and then transports the end board to a desired location over the support plane or over the top of the stack and releases the end board thereon. The gripper means is preferably a vacuum means and more preferably at least one, and yet more preferably, a plurality of vacuum cups.

A preferred means to move the end board arm and end board gripper comprises a means to move the end board arm vertically, parallel to the vertical support wall, along an end board axis. There is a means to rotate the end board arm around the end board axis. In this way, the end board arm can be rotated out of the stack path when not in use. The end board arm can be rotated so that the gripper is above an open hopper containing a stack of end boards. By open hopper it is meant that the hopper need have only one support wall, but preferably has two adjacent support walls. This can be a vertical support wall and preferably a transverse support wall. However, the hopper need not have opposing walls. The gripper is rotated with the arm above the hopper and then vertically moved down into the hopper along the end board axis. The gripper intercepts and grips the top end board. The gripper is then lifted and moved over the support plane of the primary support means and the end board released. The back edge of the end board rests against the vertical support wall aligning it. The end board arm rotates out of the path of the oncoming stack and the stack forms. At this time the arm swings back and grips another end board having it ready for insertion onto the top of the stack. Upon completion of the stack, the primary support moves down to enable the base of the stack to be supported on the base support. The next stack is being formed on the feed support plane. Simultaneously, the arm moves vertically so that the gripper is above the top of the stack and the arm swings in so that the gripper containing the end board is above the top of the stack. The end board is released and the arm swings away. Immediately thereafter the formed stack containing end boards on both sides is transported to the next operation, i.e., the bundler.

After bundling the bundled stacks are further transported along a base travel path to a palletizer, preferably a multi-clamp palletizer having a vertical support wall aligned with the vertical walls of the stacker, and the bundler. The palletizer then removes the bundles from the system and transfers them onto pallets for further processing.

DESCRIPTION OF THE PREFERRED EMBODIMENTS

The preferred embodiment of the stacking system of the present invention will be apparent to those skilled in the art by reference to the accompanying Figures.

Figure 1:
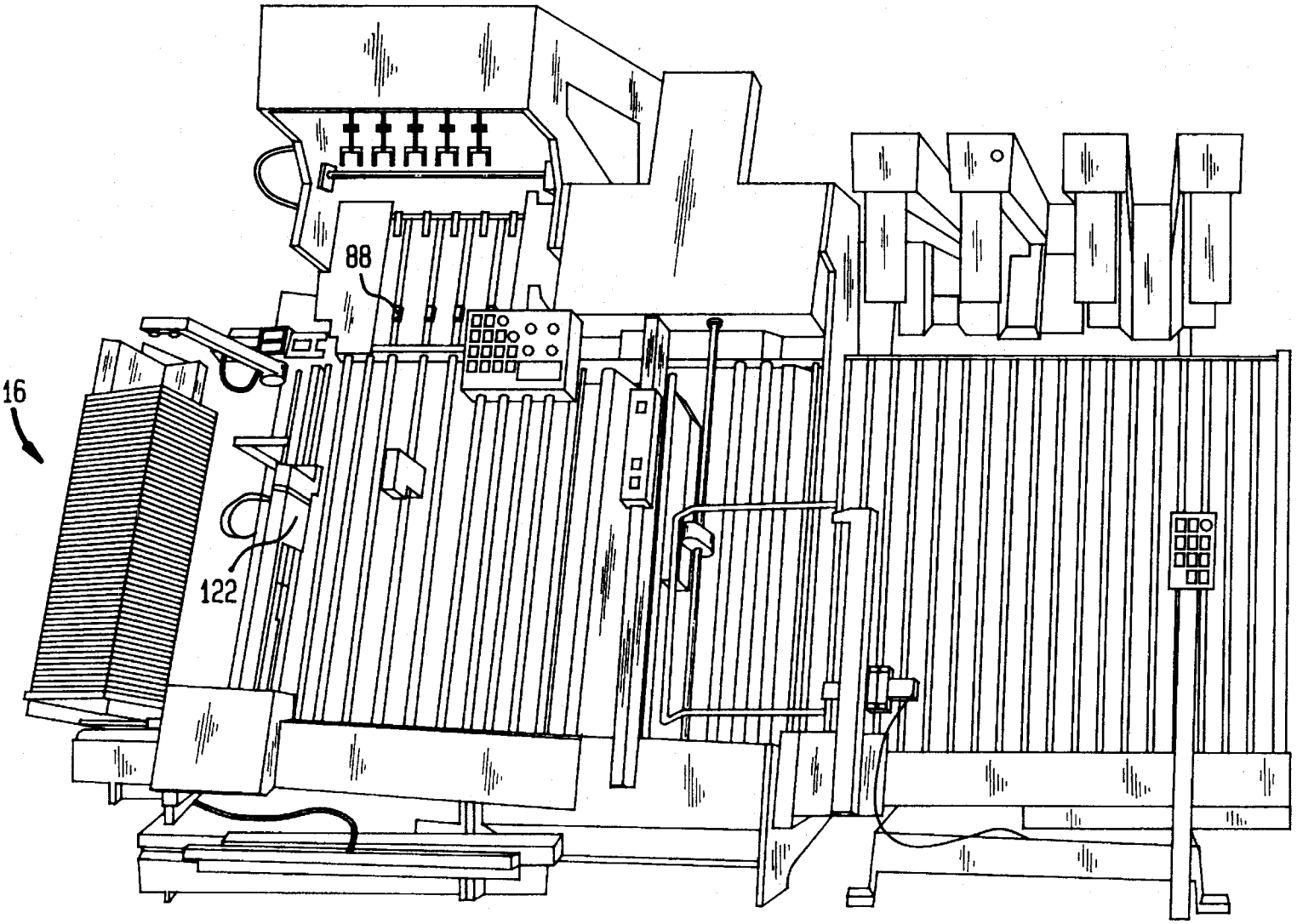
FIG. 1 is a front view of the vertical stacker system of the present invention.
Figure 2:
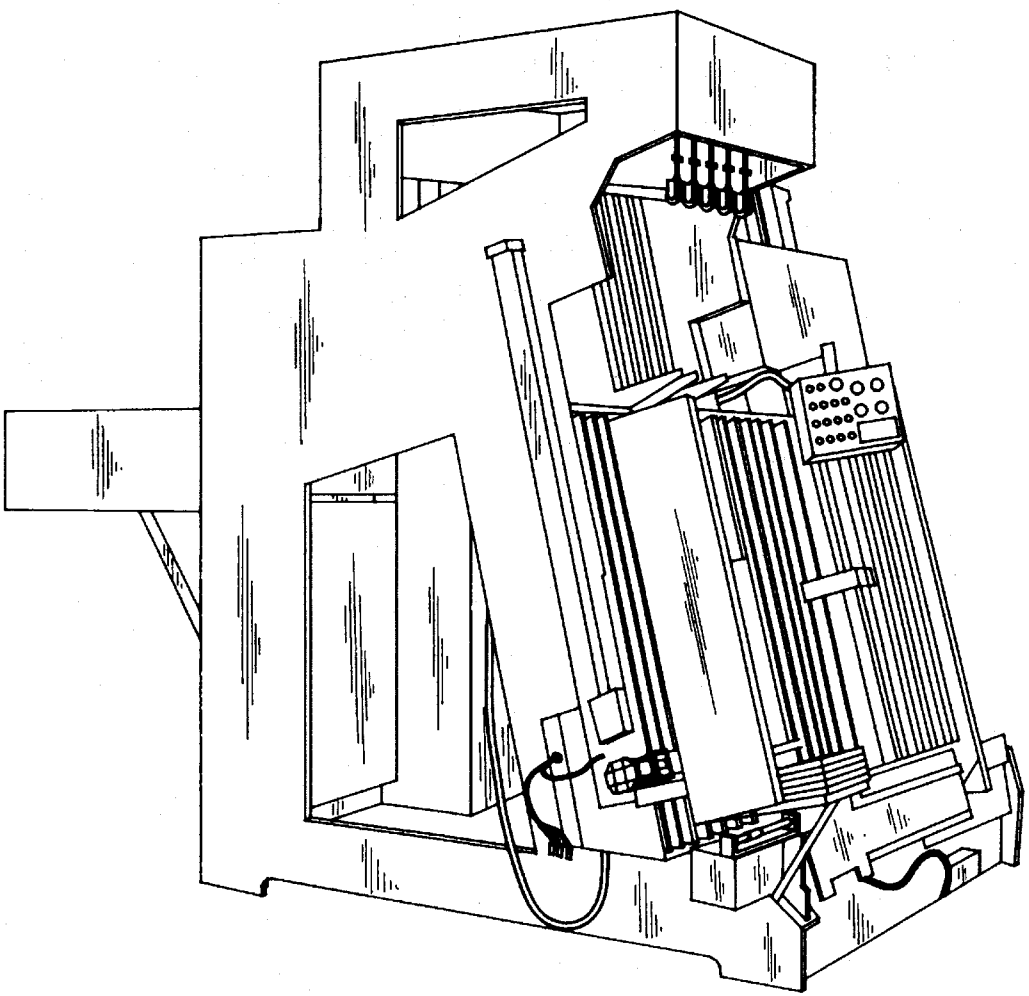
FIG. 2 is a view in perspective of the stacker of the present invention.

FIG. 1 is a front view in perspective of a full stacking system of the present invention. FIG. 2 is a view in perspective at an angle showing the side view of the end board insertion feature and the vertical stacker apparatus.

Figure 4:
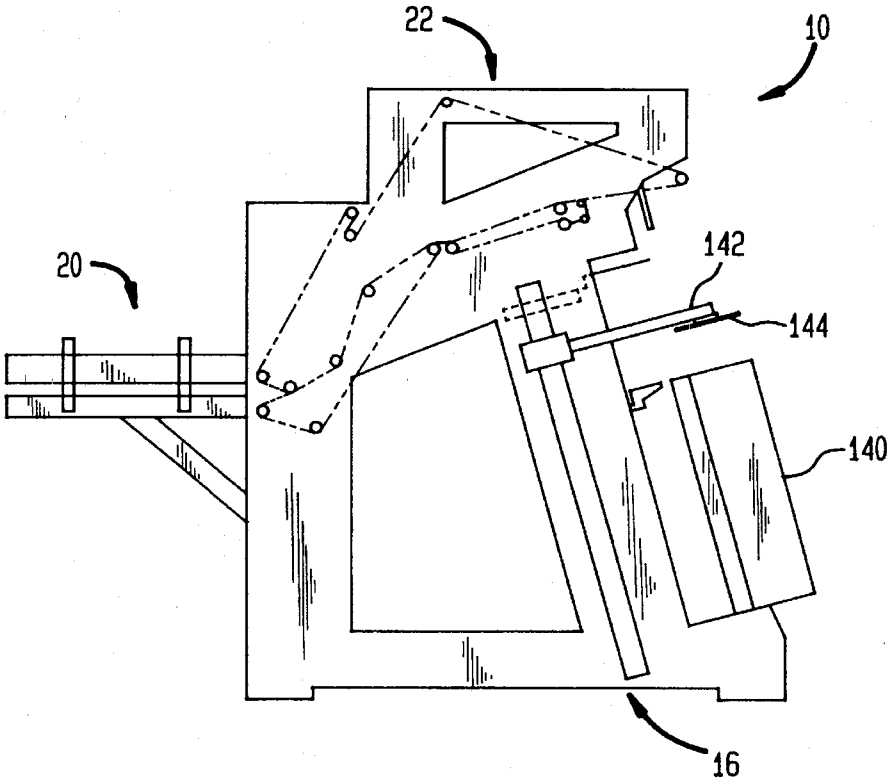
FIG. 4 is a schematic side view of the present invention showing the stacker apparatus and the end board insertion feature.
Figure 3:
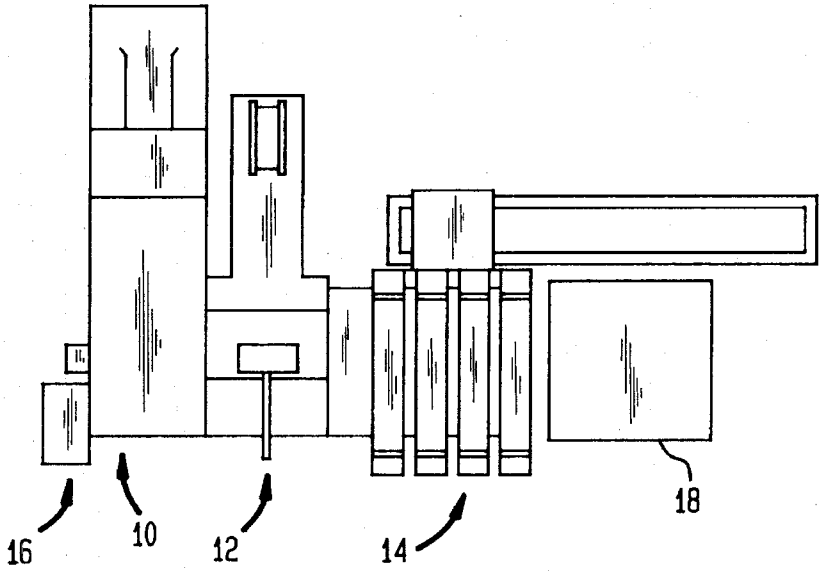
FIG. 3 is a schematic top view of the present invention showing the stacker, associated bundler, and a palletizer.

Reference is made to FIGS. 3 and 4 showing a top view and side view of the system illustrated in FIGS. 1 and 2. Referring to FIG. 3, the stacking system comprises in combination a vertical stacking apparatus 10, a bundling apparatus 12 and a palletizing apparatus 14. Also, schematically illustrated on FIG. 3 is the preferred location of the end board insertion feature 16, as well as a pallet 18 to receive bundles from palletizing apparatus 14.

Referring to FIG. 4, there is shown the travel path of signatures coming to vertical stacking apparatus 10. In the embodiment illustrated in FIG. 4 there is a gapping or interrupt apparatus 20 through which an oncoming stream of signatures are fed. The signatures pass through the gapping apparatus 20 to a suitable stacker conveyor system shown as conveyor belt system 22.

In accordance with the system shown in FIGS. 1 through 4, a stack of signatures enters the system through the conveyor feed system 22 in stacker 10. The signatures are stacked in stacker 10 to form a vertically disposed stack. The vertically disposed stack is transported to strapping and bundling apparatus 12 where the stack is compressed and secured by a suitable strap. The strapped bundle is then transported to palletizing apparatus 14. The palletizing apparatus 14 removes the bundles and deposits them on pallet 18 for transportation away from the system.

The system of the present invention is simple to operate and capable of handling signatures having an incoming speed in a range of from up to 80,000 or more signatures per hour, and preferably 10,000 to 50,000 sheets per hour. The most preferred speed rates are in the range from 10,000 to 50,000 sheets per hour. The system can be easily adjusted to be used with devices using signatures at any speeds in the indicated range, whether signatures come at a variable rate. Certain of the features are shown in preferred positions but are not necessarily restricted to use at the specifically indicated location.

A stream of incoming signatures typically arrives on a suitable conveying means such as a conveyor belt. It is desirable in the operation of a vertical stacking apparatus to have a means to interrupt the stream or form a gap. The preferred gapping apparatus is located as shown in FIGS. 4 through 8 with an alternate gapping apparatus shown in FIG. 9. A flow of signatures enters the gapper 20 on lower entry conveyor 24.

The lower entry conveyor can be a separate conveyor belt or segment of the conveyor belt bringing the signatures to the vertical stacking apparatus 10. Opposing the lower entry conveyor segment of the gapper 24 there is an upper gapper conveyor belt 26. The relative speeds of lower entry conveyor 24 and upper gapper conveyor belt 26 can be controlled relative toward one another. Upper gapper conveyor belt 26 can be lowered onto the oncoming stream of signatures 28. By controlling the relative speeds of the lower belt 24 and upper belt 26 the lower stream of signatures 28 can be interrupted and a gap formed. This gap is important in vertical stacking apparatus 10 to enable completed stacks to be removed and new stacks to be formed. In a preferred operation, the gapping apparatus 20 further comprises an interrupter means which can be a lance or hook 30 which simultaneously advances at the same speed as upper gapper conveyor belt 26.

In a preferred embodiment the speed of the lower conveyor belt remains the same as the oncoming stream. The speed of the upper gapper conveyor belt can be varied to accelerate or decelerate that portion of the stream of signatures with which it is in contact. By accelerating signatures, they will be pulled away from the signatures not yet in contact with the belt and a gap formed. More preferably, upper belt 26 is operated at a slower speed to permit the flow of signatures which have passed the gapping apparatus 20 to move and be processed in the vertical stacking apparatus 10 while the gapper 20 is slowing down the oncoming signatures and actually interrupting their flow to cause separation in the stream.

Figure 7:
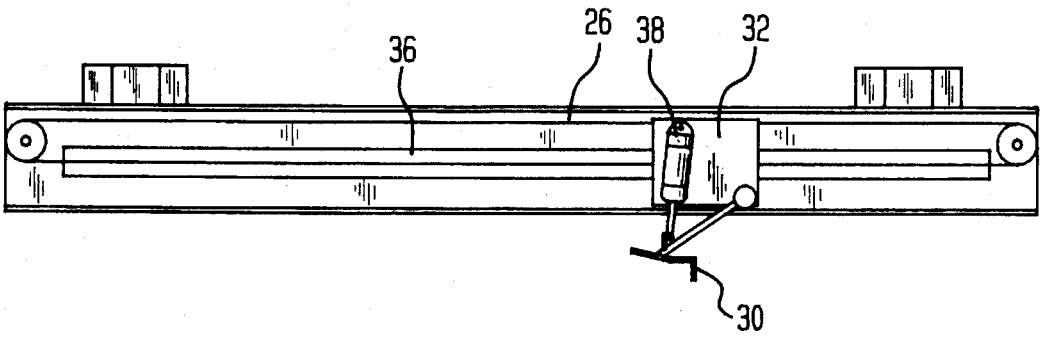
FIGS. 7 and 8 are side and top views of the signature interrupt mechanism.
Figure 8:
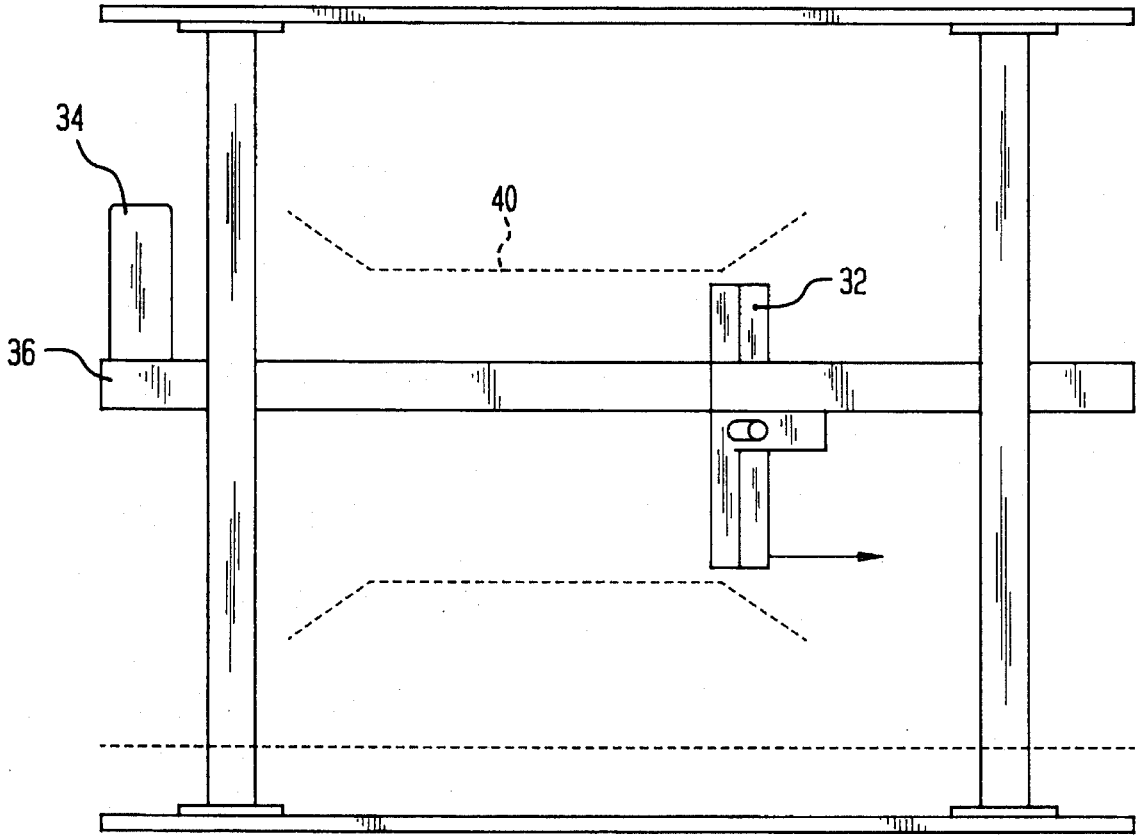

In a most preferred embodiment, the lance or hook 30 travels at a simultaneous speed as upper belt 26 in the direction of the signatures being transported by suitable hook transport means 32 associated with the upper conveyor belt. There is suitable means to raise and lower upper gapper conveyor belt 26 and hook toward and away from the flowing stream of signatures supported on lower entry conveyor 24. In a most preferred embodiment in operation, the upper gapper conveyor belt has means to control its speed to be less than the lower entry conveyor belt 24 speed. Preferably the speed of the upper belt 26 is one-third and more preferably one-half of the speed of the signature stream. Upon lowering of the upper conveyor belt to contact the moving signature stream, the hook 30 or lance is simultaneously lowered to intercept the leading edge of the stream of a signature at which a gap is to be formed. The hook is advanced with the same speed as the belt 26. Referring to FIGS. 7 and 8, the hook transport 32 is transported by transport motor 34 on belt 36. The hook 30 can be raised and lowered by hook piston assembly 38. There can be a gapper jogging means 40 to maintain the signature stream aligned during the formation of the gap.

Alternately, when the speed of upper gapper conveyor belt 26 is increased more rapidly than the stream of signatures 28 it causes greater separation of oncoming signatures. This can be used to prevent piling up of the overlapping signatures.

Figure 9:
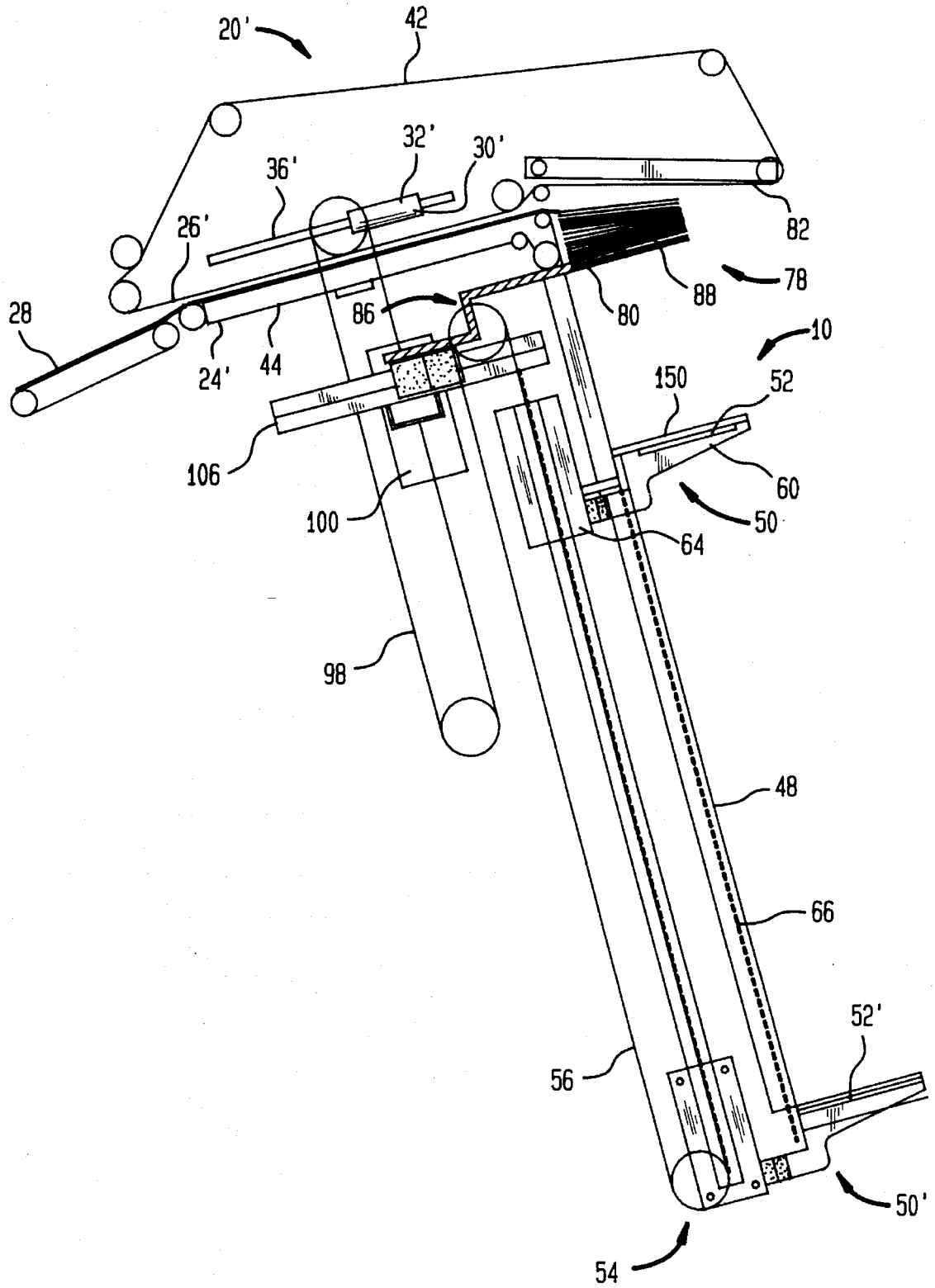
FIG. 9 shows an alternate embodiment of the gap interrupt and the vertical stacker with the feed fork inserted and receiving signatures.

FIG. 9 shows an alternate embodiment of the gapping apparatus 20' shown at the feed position of the vertical stacking apparatus 10. This apparatus has corresponding parts to the gapper 20 reviewed with respect to FIGS. 5 through 8. Corresponding elements are shown having the same reference characters primed. Lower entry conveyor 24' and upper gapper conveyor belt 26' are segments of the upper and lower feed conveyors 42 and 44, respectively. These segments of the belt can be independently raised or lowered. As with the preferred embodiment, it is preferred that the upper gapper conveyor belt segment 26' be capable of being lowered onto the moving stream.

Figure 5:
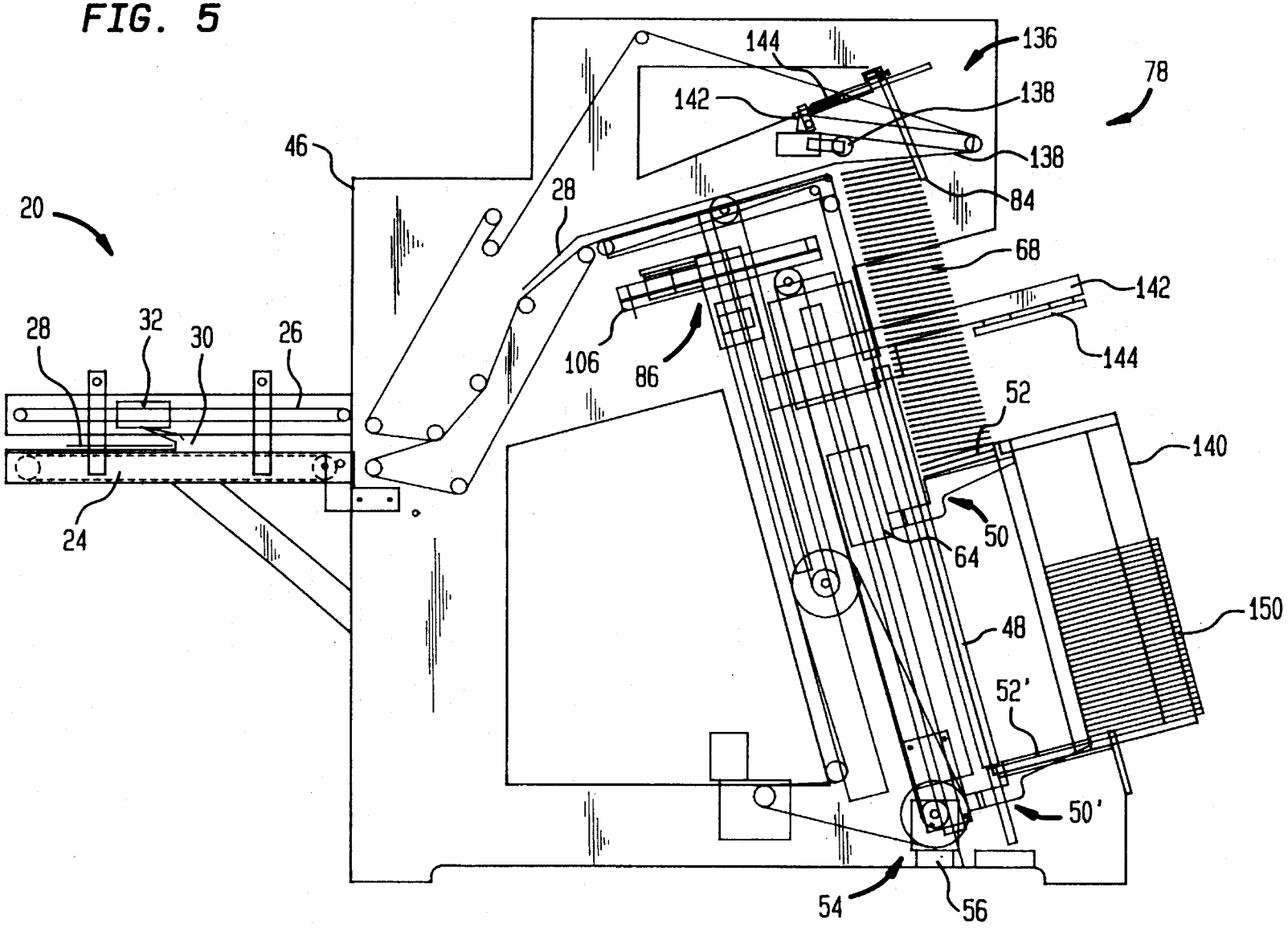
FIG. 5 is a detailed side view showing the stream interrupt means, the end board insertion means, the gapping means, the means to measure the tension on the belt above the forming stack, and the means to translate the primary fork and feed fork assemblies with the feed fork being retracted at this point.
Figure 6:
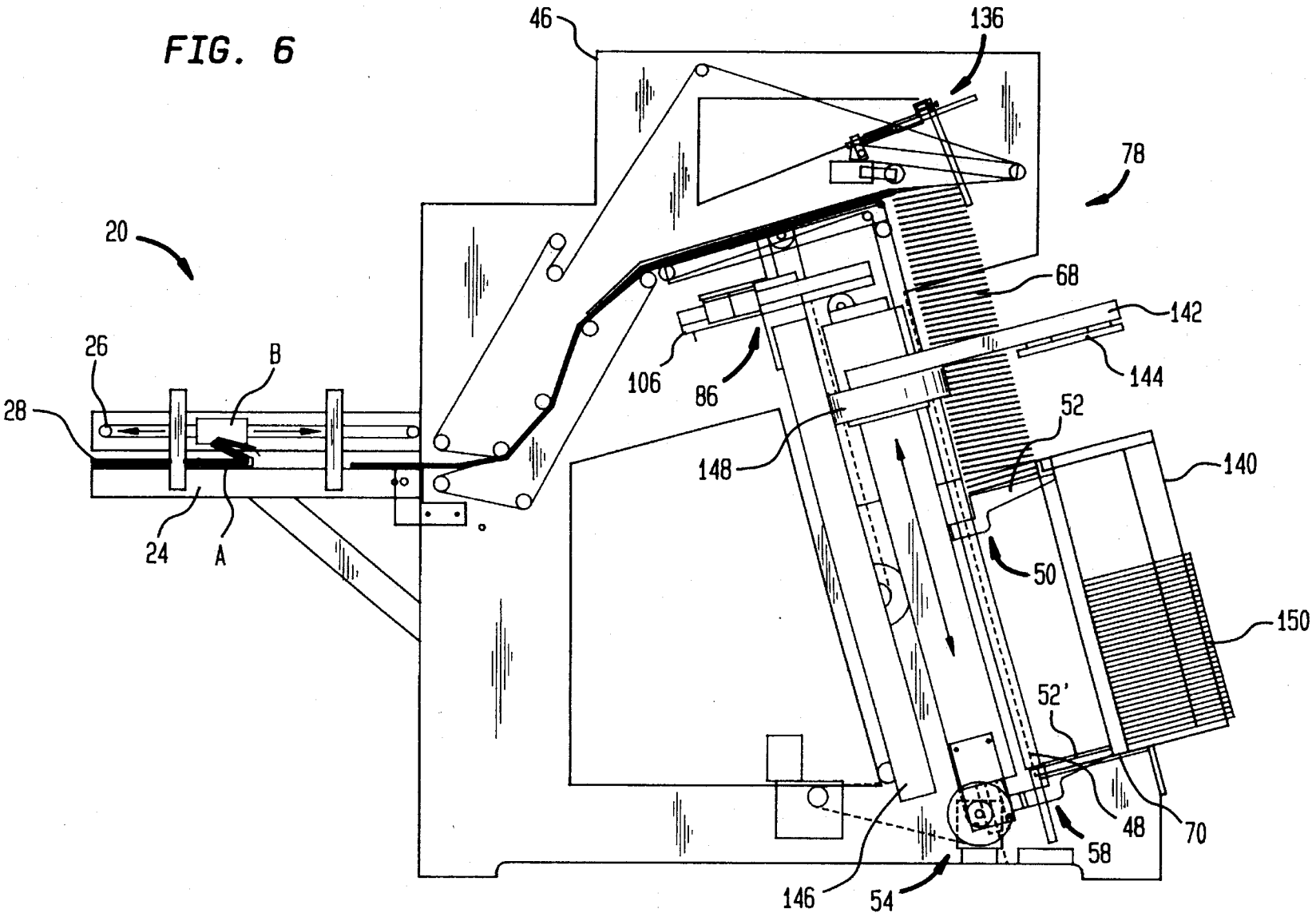
FIG. 6 is a side view of the vertical stacker of the present invention showing the end plate insertion means.

The vertical stacking apparatus 10 of the system of the present invention is shown in FIGS. 1 and 2 in perspective with detailed side views shown schematically in FIGS. 5, 6 and 9.

The vertical stacking apparatus 10 comprises a frame 46. There is a vertical support wall 48 supported by frame 46. The vertical support wall 48 is preferably made up of a plurality of rollers having a plane which defines the vertical support wall 48. The plane of the roller of these support rollers also defines the angle of the vertical stacker to the horizontal. Preferably, the vertical support wall is at an angle of greater than 45°, and most preferably from 45° to 75° with a common angle being 60° to the horizontal.

There is a sliding support assembly 50. The sliding support assembly 50 is shown in a position toward the top of the vertical stacker, while the sliding support assembly 50' is the same assembly shown at the bottom of the vertical wall 48. The sliding support 50 defines a support plane or surface 52 which intersects and is preferably transverse or perpendicular to the vertical support wall 48. There is a slide drive means 54, such as driven slide chain 56, driven by slide chain motor 58 to translate the sliding support assembly 50 along support wall 48.

In a preferred embodiment, the slide support assembly 50 comprises a slide support fork 60. The slide support fork 60 comprises a plurality of slide support prongs 62. The upper surfaces of the slide support fork prongs 62 define the support plane 52 of the sliding support. Preferably, this support plane 52 is perpendicular to the vertical support wall 48. The sliding support fork prongs are connected to a sliding support 64 which in turn is connected to slide chain 56. The prongs 62 extend from between vertical support wall rollers 66 as shown in FIG. 10.

There is a suitable means to feed signatures to the support plane 52 of the sliding support assembly 50 and form a stack of signatures 68 thereon. The feed means, as recited above, can be a conveyor system.

Upon completion of the formation of the stack, the sliding support assembly with sliding support plane 52 are lowered along vertical wall support 48. At the lower end of vertical wall support 48 is a base support 70. Base support 70 has a base support plane 72 as shown in FIG. 11. The base support plane preferably is parallel to the support plane 52 of the sliding support 64. In the preferred embodiment, the base support 70 comprises a plurality of base support rollers 74. The sliding support assembly in the preferred embodiment comprises sliding support fork prongs 62 which lower through spaces between base support rollers 74 thereby depositing the stack of signatures 68 on the base support 70. The base support 70 preferably defines a base travel path 76 which is preferably defined by the plurality of base support rollers 74. The signature stack can be transported along the base travel path 76 to the next apparatus which is preferably the bundler, strapper 12.

The vertical stacker apparatus has a feed zone 78 illustrated in FIGS. 5, 6 and 9. The feed zone 78 is the portion of the vertical stacker apparatus 10 which receives the oncoming stream of signatures 28. When a stack 68 is formed, the slide support assembly slides down from the vertical wall to deposit the completed stack 68 on base support plane 72, preferably base support rollers 74. During this time the stream of signatures 28 continues to move toward the vertical wall 48, typically at very rapid speed. Accordingly, the gapping apparatus 20 provides a reprieve by forming a small interruption in the otherwise continuous stream of signatures 28. However, this gap is not sufficient in length to permit a sufficient amount of time for the completed stack 68 to be placed on the base support 70, transported from the stacking apparatus 10 along base travel path 76 out of the path of the oncoming stack of signatures, and the primary support fork 60 to return to the top of the vertical wall 48.

In accordance with the present invention there is a feed zone sliding support plane or surface which can slide along wall 48. As in the vertical wall 48, the feed zone can be a continuation of the rollers of wall 48 or separate vertical rollers. However, the feed zone need not be rollers, since the formed stack is not transported transversely to the portion of the vertical wall within the feed zone.

The feed zone sliding support plane 80 receives signatures from the signature stream 28. As the stack of signatures accumulates on the feed zone support plane 80, the feed zone support plane slides down the vertical wall toward the base support 70. The travel of the feed zone support plane 80 is limited to the feed zone 78. When the primary sliding support plane 52 has been relieved of the completed stack, it moves up the vertical wall via slide chain 56 and the forming stack 68 on the feed zone support plane 80 is deposited onto the support plane 52 of the primary sliding support assembly.

In a preferred embodiment of the present invention, signatures are fed along a conveyor system 22 to lower feed conveyor 44 and immediately before the feed zone are fed between opposing feed conveyors, upper feed conveyor 42 and lower feed conveyor 44. Lower feed conveyor 44 ends at the vertical support wall 48. The upper feed conveyor 42 has an upper feed conveyor feed extension 82. There is also a suitable means to stop the forward progress of the cylinders, such as signature stop 84. The oncoming signatures are thereby shepherded into place by upper and lower feed conveyors 42 and 44. Their forward progress is stopped by signature stop 84 and they are continually forced by feed extension 82 onto the stack feed zone support plane 80. This quickly and neatly forms a stack on feed zone support plane 80.

A preferred feed zone support assembly is illustrated in FIGS. 5, 6 and 9. The preferred feed zone sliding support assembly 86 comprises a feed zone support plane 80. The support plane 80 is on a suitable feed zone support which is preferably a feed zone fork 88. The feed zone fork 88 comprises a plurality of feed zone fork prongs 90 as shown in FIG. 10. There are preferably a plurality of feed zone prongs on the fork with the preferred number of prongs being equal to the number of prongs on the primary support fork 60. Preferably, there are from two to six prongs 62 on the primary sliding support fork 60 and corresponding number of prongs 90 on the feed zone support fork 88. The upper surface of the feed zone support prongs defines the feed zone support surface 96 (i.e., feed zone support plane 80).

There is a drive means to drive the feed zone support assembly to enable the feed zone support to move up and down along the vertical wall 48 in the feed zone 78. The drive means preferably comprises a driven feed zone chain 98 which is driven by a suitable means, such as a feed zone drive chain motor (not shown). The feed zone support fork 88 is supported on the chain by a suitable feed zone support 100. The feed zone chain and feed zone support are preferably behind the vertical wall 48. The feed zone support fork prongs 90 extend from the feed zone support through slots, preferably between feed zone rollers 102 in the feed zone.

The slots are vertical and preferably aligned with the slots in the same area of the wall 48 with the prongs 62 of the primary sliding support fork 60.

The preferred feed zone support assembly preferably has feed zone support prongs 90 extending through the feed zone slots 104, as shown in FIG. 10. The feed zone support fork prongs are preferably retractable so that the fork can be retracted completely behind the surface defined by the front of wall 48. There is a suitable retractable piston 106. FIGS. 5 and 6 illustrate the feed zone with the feed zone fork prongs retracted, while FIGS. 4 and 9 illustrate the vertical stacker with the feed zone fork prongs 90 inserted into the path of the oncoming stack of signatures. When the primary sliding support assembly 50 has been lowered away from the oncoming stream of signatures 28, the gap formed at the gapper is momentarily present during which time the feed zone support prongs 90 are shot out in front of the vertical wall 48 to receive oncoming signatures. As the signatures build on the feed zone support surface 96 the feed zone support assembly slides down via feed zone chain 98.

After the formed stack on the sliding support assembly 50 has been removed, the slide support assembly 50 moves up the vertical wall to a transfer zone shown in FIG. 10. The support plane 50 having an end board 150 is in the transition zone 108 as shown in FIG. 10.

When the bottom of the transition zone support fork intersects the end board 150 supported on support plane 42, the feed zone support prongs 92 rapidly retract and the forming stack of signatures is deposited on end board 150. This all occurs very rapidly and the primary support surface 52 continues to move downwardly as the stack is built.

Figure 10A:
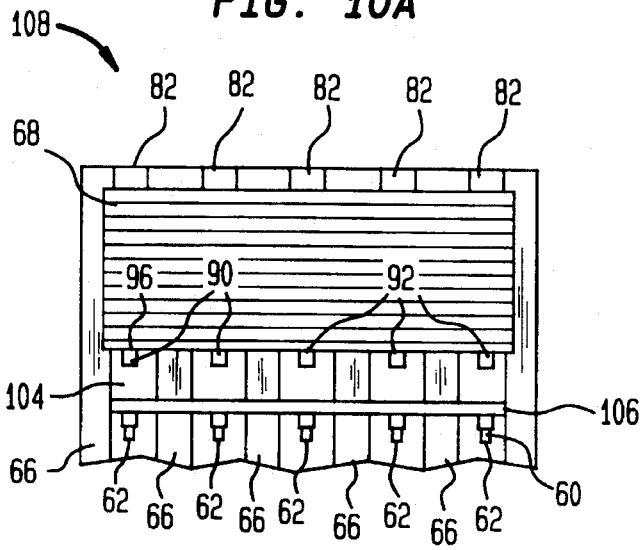
FIGS. 10A–10E illustrate the retractable guides at the point where the stack is transferred from the feed fork to the primary fork.
Figure 10B:
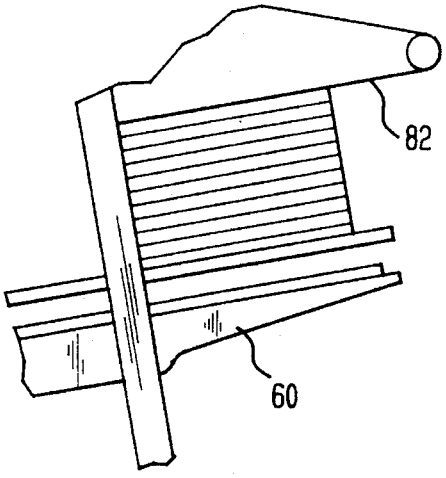
Figure 10C:
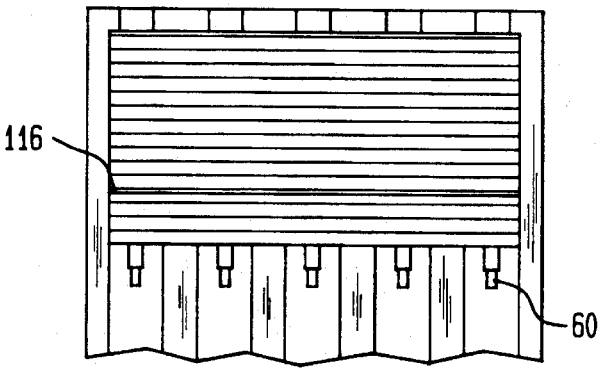
Figure 10D:
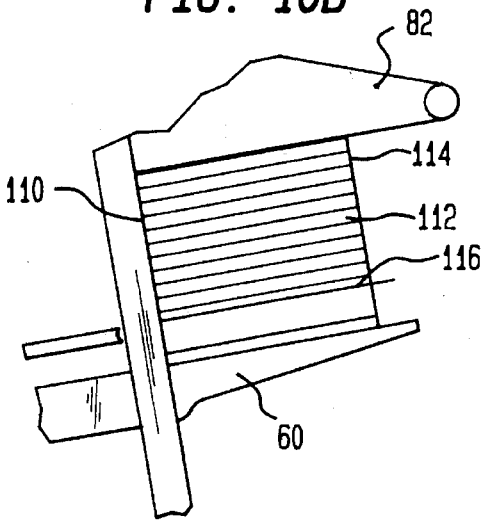
Figure 11B:
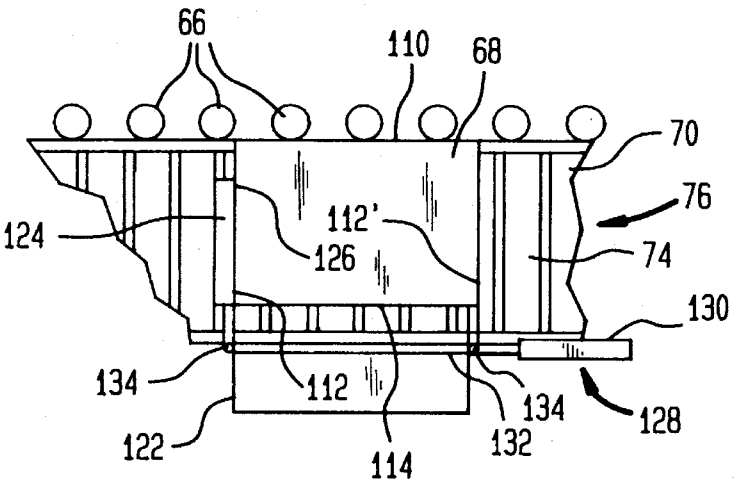
FIGS. 11A and 11B illustrate a carriage with transverse rotatable support arms.
Figure 11A:
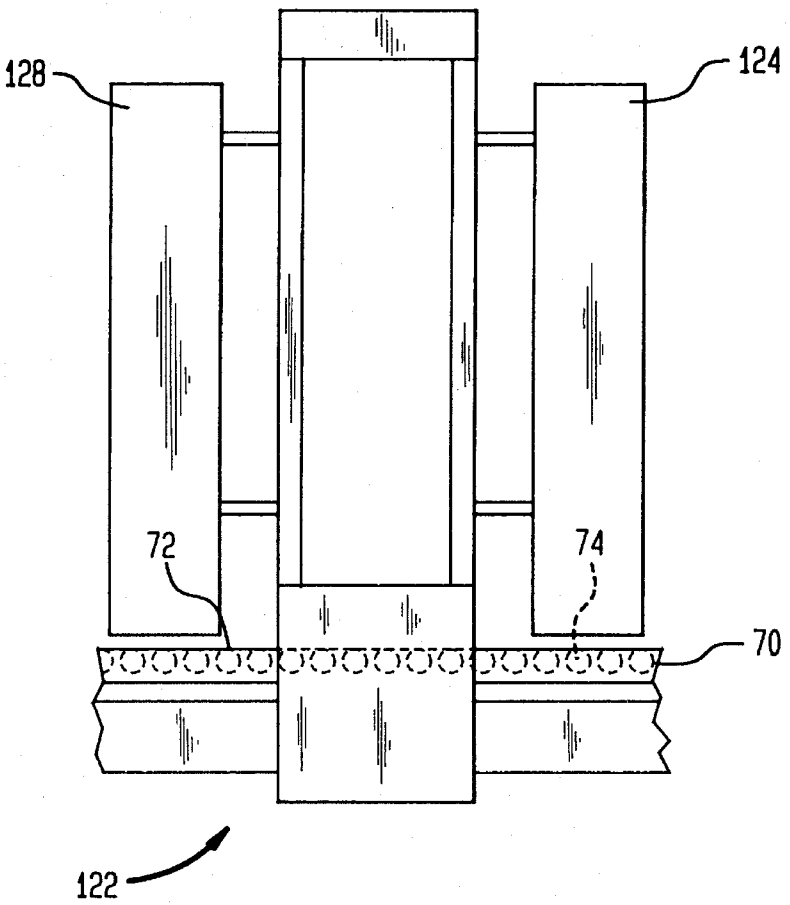

Different types of signatures can be stacked. The signature stack 68 has a support side 110, two transverse sides 112 which are transverse to the wall 48 and the front side 114. The stack further has a base which is supported on plane 52 and a top which is the top of the last signature on the stack. When signatures are symmetrical from transverse side to transverse side of stack, the signature stack forms uniformly with straight transverse sides 112 as shown in FIG. 11B. However, often times the signatures are not uniform from side to side, for example, when there is a fold at one edge and the other transverse edge is opened. Referring to FIG. 10A it is seen that the signature stack 68 forming in the feed zone is maintained between a plurality of feed extension belt segments 82 and feed zone support prongs 92. There are different forces between the prongs 92 and the belt segments 82 moving transversely across the stack from transverse side to transverse side. Upon retraction of the prongs 92 there is a slight rotation in the stack forming a slight inconsistency or notch 116 as shown in FIG. 10C. Generally, this notch 116 has no adverse affect on processing, however, it is unsightly and should be avoided.

Figure 10E:
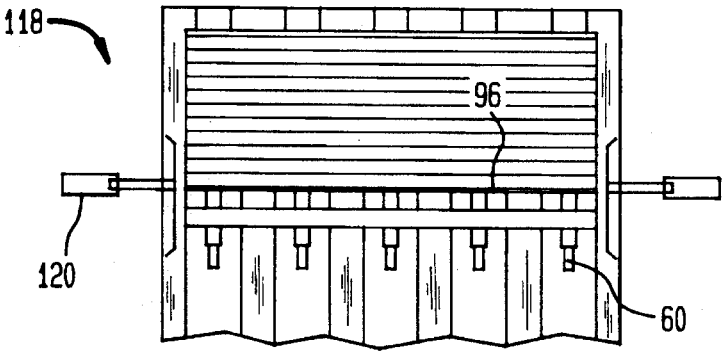

In accordance with the present invention there is a guide means located in the transition zone which abuts the transverse sides 112 at the time the prongs 92 are retracted. This has been found to maintain a continuous uniform stack without notch 116. The guide may be permanent, it may be a roller, or it may be a small conveyor belt. However, the preferred guide 118 shown in FIG. 10E is a retractable guide. The guide has means, such as pistons 120, which are controlled to abut the transverse stack sides 112 when the stack is transferred from the feed support plane 96 to the primary support plane 52, on which there can be an end board 150.

When the completed stack is resting on base support 70, there is a means to transfer the signature stack 68 from the vertical stacker to the next operation, such as bundler strapper 12. A transport device useful in the present invention comprises a carriage shown in FIG. 1 and 2 and illustrated in FIGS. 11A and 11B, as reference character 122 which is juxtaposed to base travel path 76. The carriage preferably travels parallel and adjacent to base travel path 76. The transport device comprises a means to propel the stack intact. By this it is meant that the stack is propelled in a manner so that the alignment of the signatures along the axis of the stack is maintained. Preferably, the transport device comprises the carriage 122 and at least one arm extending from the carriage. The arm has a bracing surface 126. There is a means to position the arm 124 transverse to the support wall 148. Movement of the arm 124 in the transverse position causes the bracing surface 126 to face a transverse side 112 of stack 68. Propelling the carriage along path 76 will then cause the bracing surface to intercept and propel the stack 68.

In a particularly preferred embodiment, the transport device comprises the first arm 124 as recited and further comprises a second arm 128. The second arm likewise has a means to position the second arm 128 transverse to the support wall 148. The second arm has a second arm bracing surface 130. The second arm bracing surface when positioned transverse to wall 48 is parallel to a transverse edge 112' of stack 68. When both arms are positioned transverse to wall 48, bracing surface 126 opposes second arm bracing surface 130. When the carriage is moved in front of the stack 68, the first arm bracing surface 126 and second arm bracing surface 130 can be moved to brace the stack 68 between the first and second arm bracing surfaces 126 and 130.

Preferably, the distance between the arms on carriage 122 can be varied. This can be accomplished by having first or second carriage arms 124 or 128 being capable to slide in channel 132 toward and away from each other. Additionally, the arms can be controllably rotated about arm pivots 134.

During normal operation, the bracing surfaces are pivoted to a retracted position out of line with the base support 70. Second arm 128 shown in FIG. 11B is in such a position. When the stack is formed and ready to be transported, the carriage arm 124 and second arm 128 are pivoted transverse to the stack and abut the transverse sides 112 and 112' of the stack. The stack is then fully supported and can be propelled intact, without becoming misaligned.

The base travel path 76 is preferably made up of a plurality of rollers. The rollers can be driven rollers to transport a completed stack 68 from the stacker apparatus 10 to the bundler and strapping apparatus. In accordance with the present invention, these driven rollers can be used in conjunction with or independently of the carriage 122. Where driven rollers are used, in accordance with the present invention, these driven rollers can have a slip clutch or free gear effect associated with them. If the stack is moving too fast the rollers will convert to a free rolling state. This will avoid unwarranted stress between the base end plate and the rollers.

The present invention can optionally and preferably further comprise a means to measure the tension in the feed zone at the feed extension of conveyor belt 82 associated with the accumulating stack. The stack 68 can be on the feed zone support plane 80 or the primary support plane 52. The force exerted on the top of the forming stack 68 by feed belt extension 82 is measured and the rate at which the feed zone support or the primary sliding support assembly descends can be controlled. Thus, if means to measure the tension or pressure against extension 82 indicates that the pressure is increasing, the sensor will communicate this to a means to control the rate at which the supported base of the stack is moving down the vertical stack wall. Accordingly, if the signature stream increases in speed, the tension on extension belt 82 will increase and the rate at which the stack support assemblies 50 or 86 move down the wall will be increased. Conversely, if the pressure decreases, the rate at which the stack will be forming will decrease. Therefore, this is an instantaneous self-compensation for changes in stack rate. Reference is made to FIG. 5 and 6 showing a means to measure the tension in extension belt 82.

Tension sensor assembly 136 is shown in FIG. 5 in detail. There is a spring-loaded roller 138 above the belt extension 82 at the point where the stack 68 is continuously being built. As the pressure between the support plane 52 and the belt extension increases, the increased pressure (or tension in the belt) is transferred from the roller through pivot assembly 142 and spring 144 to a sensing means. The increase in tension is immediately signaled to the means to drive slide chain 56 or feed zone chain 98 to increase the rate of descent. The rate at which the chain moves will thereby be instantaneously changed to compensate the differences in motion sensed by roller 138. It is recognized that other suitable means can be applied directly to the top of the stack to measure distances of motion of the roller, as well as tension in the belt caused by the changes in the stack at the point where it is formed. Additionally, the height of the forming stack 68 can be sensed by roller 138 to control the rate of descent of the stack 68.

It has been found that even small variations and thickness of each sheet will add up in large stacks so that manual adjustment of the speed of descent of the stack has been previously required. The monitoring device shown as assembly 136, which is preferably over the stacking area, but could measure increased tension in the belt 82 anywhere, can instantaneously adjust the speed.

Yet an additional and preferred feature of the vertical stacking system of the present invention is the insertion of end plates or boards 150 at the base and top of the stack 68. The preferred means of the present invention to place the end board is illustrated in FIGS. 1 and 2. Reference is made to FIGS. 4 through 6 showing the preferred means to place end boards 150 according to in the present invention.

The means comprises an end board hopper 140. As shown in FIGS. 1 and 2, an advantage of the present invention is that the end board hopper 140 can be open on at least two adjacent sides. The importance is that the end boards do not have to be carefully or precisely stacked.

The means to place end boards further comprises an end board arm 142 having an end board gripper 144. There is a means to move the end board gripper 144 from the hopper 140 to a position above the support plane 52 of the primary support assembly 50. Hopper 140 is located so that the end board arm can position the end board gripper above end boards within the hopper and intercept such end boards. In FIGS. 5 and 6, the end board hopper is disposed in front of the end board arm and to the side of vertical wall 48.

The end board gripper 144 has means to grip the end board and means to release the end board. In a preferred embodiment the end board gripper 144 comprises one or more suction or vacuum cups. The end board gripper 144 is placed on the top surface of an end board 150. The vacuum is applied and the end board 150 is lifted from the hopper by the end board gripper. The end board arm 142 then moves so that the end board and end board gripper is at a desired location and the vacuum is removed and the end board released. Preferably, an end board is picked up by the end board gripper 144 and deposited on primary support plane 52. Upon completion of formation of the stack 68, the stack 68 moves down toward the base 70. Prior or simultaneously, the end board arm moves the end board gripper 144 to the end board hopper 142 to obtain another end board 150. While a stack is building in the feed zone, the end board arm moves to a suitable position so that an end board hopper 140 is deposited on top of the formed stack. At this point the formed stack has an end board at the base of the formed stack and an end board at the top and is ready to be transported to the compression and strapping zone.

A preferred end board placement means is shown in FIGS. 5 and 6. In this embodiment, the end board gripper further comprises a means to move the end board arm 142 vertically. A preferred means is a piston, such as end board piston 146, which is preferably a gland-type pneumatic piston. This enables the end board arm to move vertically in a direction parallel to the vertical wall 48 along a vertical end board axis. The end board gripper further comprises a means to rotate the end board arm about the vertical end board axis. Such a rotation means is shown as pivot means 148.

In operation, the end board gripper causes arm 142 to move down into end board hopper 140 with the end board gripper 144 above the end board. Upon interception of the end board gripper 144, which is preferably one or more suction cups, an end board is gripped on the end of end board arm 142. The end board arm 142 then slides vertically to a location at which the end board will be inserted. When either surface plane 52 or the top of a stack is in suitable position, the arm 142 is rotated by end board pivot 148 so that the end board is located above the top of the stack. The end board is then lowered and the suction released and the end board is deposited on top of the stack.

The means to place an end board of the present invention avoids the necessity of being concerned about the height at which an end board is to be inserted, either on the forks or in a vertical stacker or on top of a formed stack. As recited above, an initial or base end board is first inserted onto the primary fork while a stack is being formed in the feed zone. After the stack has been transferred onto the end board on the primary support fork, the fork is lowered as the stack is formed. When a gap forms the primary fork lowers down and the feed zone fork shoots into the path of the oncoming signatures. At this point there is a gap or space between the top of the stack and the feed zone fork. The end board arm 142 rotates into the gap and deposits an end board 150 on top of the stack. The end boards are preferably deposited with an edge against the vertical wall 148. Based on the length of the arm and the controlled amount of rotation, the end board is put substantially in position with respect to the forming stack.

While exemplary embodiments of the invention have been described, the true scope of the invention is to be determined from the following claims.

What is claimed is:

1. A vertical stacking system comprising:

a frame;

a vertical support wall supported by the frame;

a sliding support defining a support plane which intersects the vertical support wall;

a slide drive means to translate the sliding support along the support wall;

a feed means to feed signatures to the support plane of the sliding support and form a stack of signatures thereon;

a base support defining a base support plane disposed to receive a stack of signatures from the sliding support, the base support comprising a base travel path defined by a plurality of rollers along which the signature stack can be transported;

a transport device, comprising:

a carriage disposed to travel along a path juxtaposed to the base travel path;

arms rotatably mounted on and extending from the carriage, the arms having a bracing surface extending from the base support parallel to the vertical support wall whereby the arms can be rotated away from the support wall during stacking and rotated to brace the completed stack; and means to position the arms transverse to the support wall whereby movement of the arms in the transverse position will cause the bracing surface to intercept the stack and propel the stack intact along the base travel path.

2. The vertical stacking system of claim 1 wherein the feed means further comprises:

a feed zone sliding support defining a feed zone support plane which intersects the vertical support wall;

a feed zone drive means to translate the feed zone sliding support along the support wall;

a signature feed means to feed signatures to the feed zone support plane of the feed zone sliding support and form a stack of signatures thereon, the stack having a support wall side which is adjacent to the vertical support wall, two transverse sides, and a front side; and a means to transfer the signatures on the feed zone support plane to the support plane comprising guides disposed to abut the transverse stack sides which move with the stack to maintain uniformity.

3. The vertical stacking system as recited in claim 1 wherein the transport device further comprises a second arm having a means to position the second arm transverse to the support wall with the second arm bracing surface opposing the first arm bracing surface whereby movement of the arms in the transverse position will cause the stack to be braced between the first and second arm bracing surfaces and to be propelled by movement of the carriage along the base travel path.

4. The vertical stacking system as recited in claim 2 wherein the guides are retractable.

5. The vertical stacking system as recited in claim 4 wherein the guides are controlled to abut the transverse stack sides when the stack is transferred from the feed support plane to the primary support plane.

6. The vertical stacking system as recited in claim 5 wherein the feed zone sliding support comprises a retractable feed zone fork comprising a plurality of feed zone prongs the upper surface of which define the feed zone support plane; and the primary zone sliding support comprises a primary zone fork comprising a plurality of primary zone prongs the upper surface of which define the primary zone support plane.

7. The vertical stacking system as recited in claim 6 where the feed zone support plane is up to 2 inches above the primary zone support plane.

8. The vertical stacking system as recited in claim 6 wherein there is a means to cause the guides to abut the transverse sides of the stack immediately prior to the intercept of the feed zone fork and the end plate.

9. The vertical stacking system as recited in claim 2 wherein the end board gripper comprises a plurality of vacuum cups.

10. The vertical stacking system of claim 1 wherein said system further comprises a means to interrupt said feed means to form a gap.

11. The vertical stacking system of claim 10 wherein said means to interrupt comprises an upper gapper conveyor belt and a lower entry conveyor belt.

12. The vertical stacking system of claim 11 wherein said means to interrupt further comprises a hook for intercepting a leading edge of a signature stream to form a gap.

13. A vertical stacking system, comprising:

a frame;

a vertical support wall supported by the frame;

a sliding support defining a support plane which intersects the vertical support wall;

a slide drive means to translate the sliding support along the support wall;

a feed means to feed signatures to the support plane of the sliding support and form a stack of signatures thereon;

a base support defining a base support plane disposed to receive a stack of signatures from the sliding support, the base support comprising a base travel path along which the signatures can be transported;

a means to place an end board comprising:

an end board hopper;

an end board arm having an end board gripper, said end board gripper comprising a vacuum means;

means to control the end board gripper to pick up an end board from the hopper;

means to move the end board arm and gripper from the hopper vertically along an end board axis to a position above the support plane;

means to rotate the end board arm around said axis; and means to release the end board on the support plane, wherein said end board gripper picks up an end board and deposits said end board at the base and top of said stack of signatures.

14. The vertical stacking system of claim 13 wherein said system further comprises a means to interrupt said feed means to form a gap.

15. The vertical stacking system of claim 14 wherein said means to interrupt comprises an upper gapper conveyor belt and a lower entry conveyor belt.

16. The vertical stacking system of claim 15 wherein said means to interrupt further comprises a hook for intercepting a leading edge of a signature stream to form a gap.

* * * * *